US005800150A

United States Patent [19]

Onoda et al.

[11] Patent Number: 5,800,150

[45] Date of Patent: Sep. 1, 1998

[54] HERMETIC COMPRESSOR HAVING VIBRATION DAMPING SUPPORT

[75] Inventors: Izumi Onoda; Yasushi Adachi, both of Fuji; Isao Kawabe, Fujinomiya; Kazu Takashima, Fuji, all of Japan

[73] Assignee: Kabushiki Kaisha Toshiba, Kawasaki, Japan

[21] Appl. No.: 756,557

[22] Filed: Nov. 26, 1996

[30] Foreign Application Priority Data

Dec. 11, 1995 [JP] Japan ..... 7-321705

[51] Int. Cl.[6] ..... F04B 39/00; F04C 29/06

[52] U.S. Cl. ..... 418/63; 418/270; 417/902

[58] Field of Search ..... 418/63, 270; 417/572, 417/902

[56] References Cited

U.S. PATENT DOCUMENTS

| | | | |
|---|---|---|---|
| 3,008,628 | 11/1961 | Gerteis et al. | 417/902 |
| 3,022,936 | 2/1962 | Connor | 417/902 |
| 4,088,428 | 5/1978 | Bannister et al. | 418/270 |
| 4,943,216 | 7/1990 | Lio | 418/270 |
| 5,405,254 | 4/1995 | Hennessy et al. | 418/166 |

FOREIGN PATENT DOCUMENTS

| | | | |
|---|---|---|---|
| 60-132094 | 7/1985 | Japan | 418/270 |
| 1-301979 | 12/1989 | Japan | 417/902 |

*Primary Examiner*—John J. Vrablik

*Attorney, Agent, or Firm*—Cushman Darby & Cushman IP Group of Pillsbury Madison & Sutro LLP

[57] ABSTRACT

A hermetic compressor which compresses compressed gas, comprising a sealing container, a compression mechanism which is housed in the sealing container and introduces the compressed gas into its inside to compress the compressed gas, and a frame for fixedly supporting the compression mechanism. A portion where the compression mechanism and the frame are abutted against each other, is provided with a solid propagation wave damping portion which damps a vibratory propagation by suddenly changing a cross section of a abutting portion.

7 Claims, 3 Drawing Sheets

HERMETIC COMPRESSOR HAVING VIBRATION DAMPING SUPPORT

BACKGROUND OF THE INVENTION

1. Field of the Invention

The present invention relates to a hermetic compressor used in air conditioners, etc., and in particular, to improvement in its noiseless structure.

2. Description of the Related Art

A hermetic compressor, which is employed in refrigerating cycle devices such as air conditioners, refrigerators, etc., includes an electric motor and a compression mechanism, which are housed in a sealing container. One end of a rotary shaft of the electric motor extends into the compression mechanism, and is formed with an eccentric portion.

The compression mechanism is provided with a main bearing and a sub-bearing which are individually mounted to opposite end faces of a cylinder so that a compression chamber is formed in the cylinder and which pivotally support the rotary shaft, and a roller which is located in the compression chamber so as to be eccentrically rotatable and which fits with the eccentric portion of the rotary shaft.

In such a hermetic compressor, the compression mechanism is mounted to the hermetic compressor by firmly attaching the outer periphery of the cylinder directly to an inner wall surface of the sealing container with methods such as welding and press fitting. Thus, in the compression mechanism, pulsations caused by the compressing operation generates vibratory energy, and the vibratory energy solid-propagates through the cylinder. As a result, the vibratory energy vibrates the sealing container. For this reason, there has arisen a problem in that harsh noise is emitted outside the sealing container.

SUMMARY OF THE INVENTION

An object of the present invention is to provide a hermetic compressor having a structure which reduces noise by preventing vibration caused in the compression mechanism from propagating through the sealing container.

To solve the above problem and to achieve the above object, the present invention provides a hermetic compressor which compresses compressed gas, comprising a sealing container, a compression mechanism which is housed in the sealing container and introduces the compressed gas into its inside to compress the compressed gas, and a frame for fixedly supporting the compression mechanism. A portion where the compression mechanism and the frame are abutted against each other, is provided with a solid propagation wave damping portion which damps a vibratory propagation by suddenly changing a cross section of an abutting portion.

The hermetic compressor is constructed in the manner described above; as a consequence, the following effects can be obtained. Specifically, according to the invention, the vibration caused by a compressive operation of compressing and discharging the compressed gas, is reflected by means of the solid propagation wave damping portion which is provided in an abutting portion where the compression mechanism and the frame are abutted against each other, so that the vibratory propagation to the sealing container can be damped. Thus, the vibration propagating through the sealing container can be damped without using any particular mechanisms when the hermetic compressor is actuated, thereby realizing a hermetic compressor having a less noisy structure.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
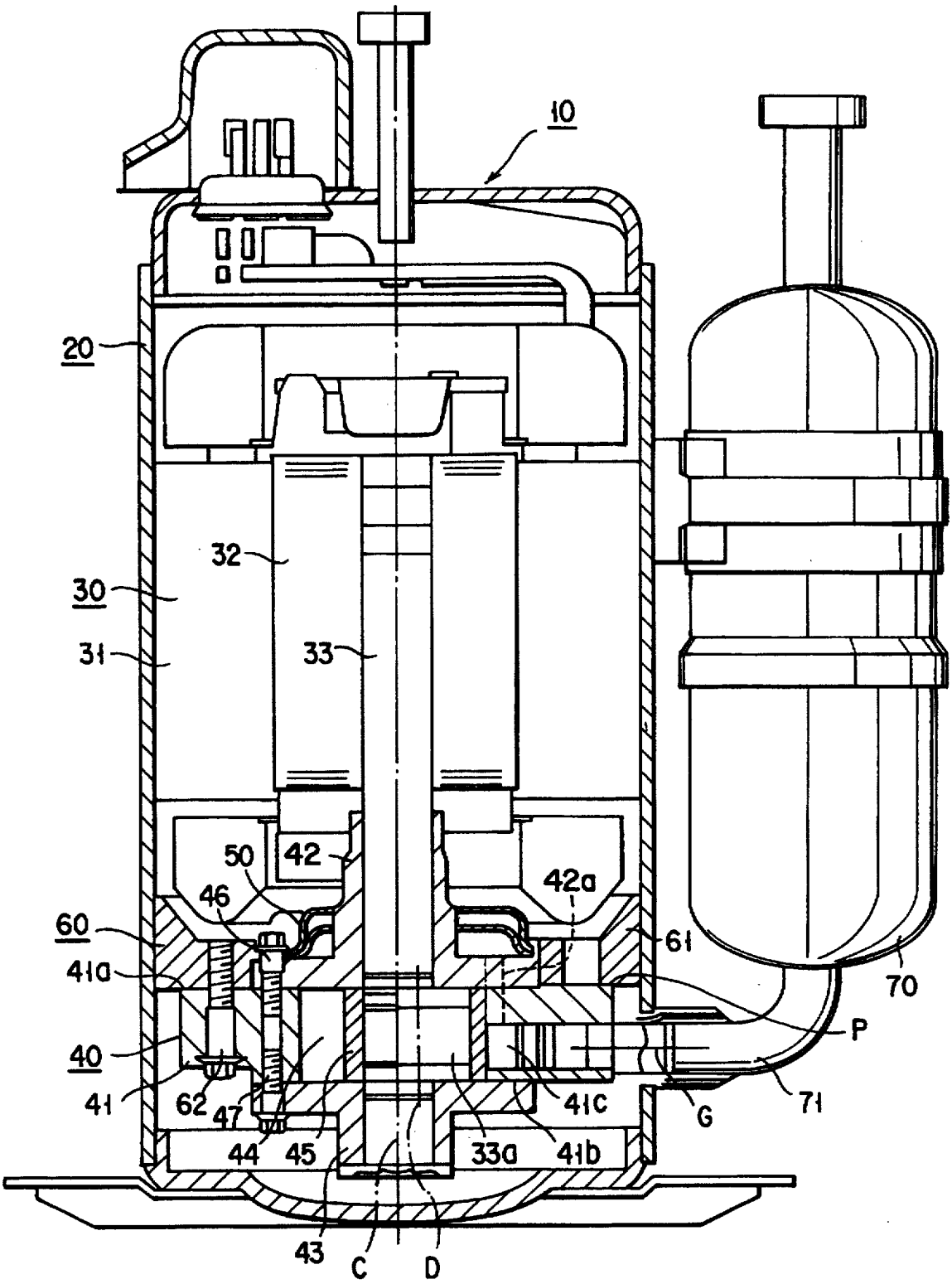
FIG. 1 is a longitudinal sectional view of a hermetic compressor according to a first embodiment of the present invention.

FIG. 1 is a longitudinal sectional view of a hermetic compressor 10 according to a first embodiment of the present invention; and, FIG. 2 is a illustrative views showing a relationship between a cylinder 41 and a frame body 61 which are incorporated into the hermetic compressor 10.

The hermetic compressor 10 is provided with a sealing container 20, an electric motor 30 which is housed in the sealing container 20, a compression mechanism 40, a muffler 50 which is mounted on the compression mechanism 40, and a frame 60 which supports the compression mechanism 40 in the sealing container 20. Also, in FIG. 1, reference numerals 70 and 71 denote an accumulator and a suction pipe, respectively.

The electric motor 30 is provided with a stator 31 which is mounted to an inner wall of the sealing container 20, a rotor 32 which is rotatably located in a hollow of the stator 31, and a rotary shaft 33 which is fixed in the center of the rotor 32. Also, one side of the rotary shaft 33 is formed with an eccentric portion **33*a* extending into a cylinder 41** which will be described later.

The compression mechanism 40 is provided with a cylindrical portion 41; a main bearing 42 and a sub-bearing 43 which are individually fitted to the first end face **41*a* and the second end face 41*b* of the cylinder 41 so that a compression chamber 44 which will be described later can be formed, and which pivotally support the rotary shaft 33; a compression chamber 44 formed in the cylinder 41; and a roller 45 which is located in the compression chamber so as to be eccentrically rotatable, and which fits with the eccentric portion 33*a* of the rotary shaft 33. Also, the cylinder 41 and the main bearing 42 and the sub-bearing 43 are connected by means of bolts 46 and 47. In FIG. 1, a dotted chain line C shows an axis of the rotary shaft 33; and, a dotted chain line D shows an axis of the roller 45**.

The cylinder 41 is provided with a suction port **41*c* for introducing a compressed gas G into the compression chamber, a blade 41***d* whose distal end elastically abuts against the outer peripheral surface of the roller 45 so as to partition the compression chamber 44. The main bearing 42 is formed with a discharge port 42*a* for discharging the compressed gas G compressed in the compression chamber 44.

The frame 60 has a frame-like body 61 arranged above the cylinder 41 as shown in FIG. 1. The frame body 61 and the cylinder 41 are firmly clamped by means of three bolts 62.

Figure 2A:
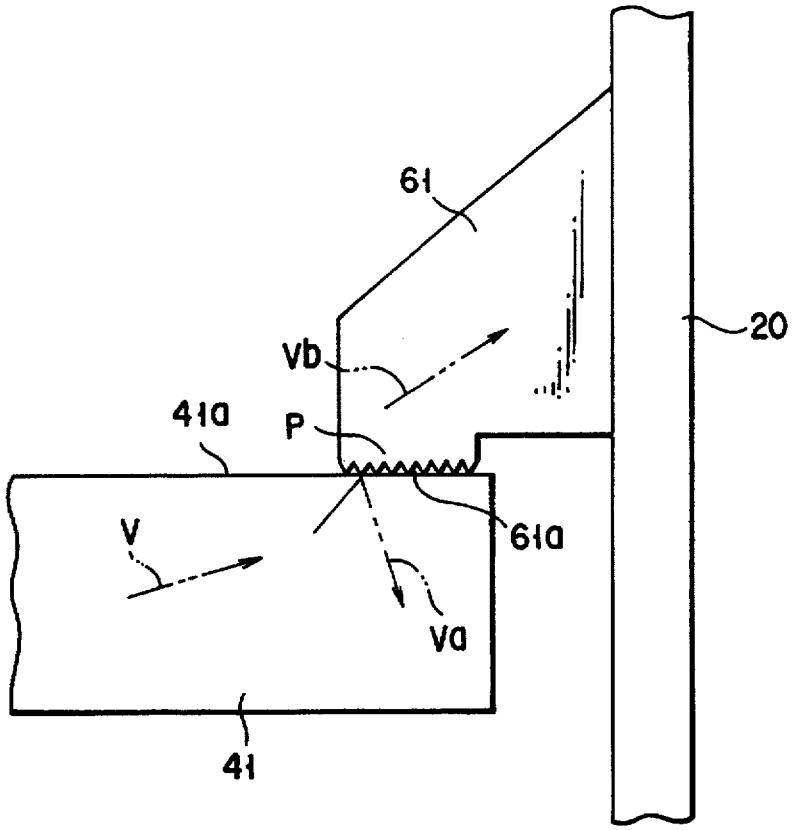
FIG. 2A and 2B are illustrative views showing a relationship between a cylinder and a frame which are incorporated into the hermetic compressor.
Figure 2B:
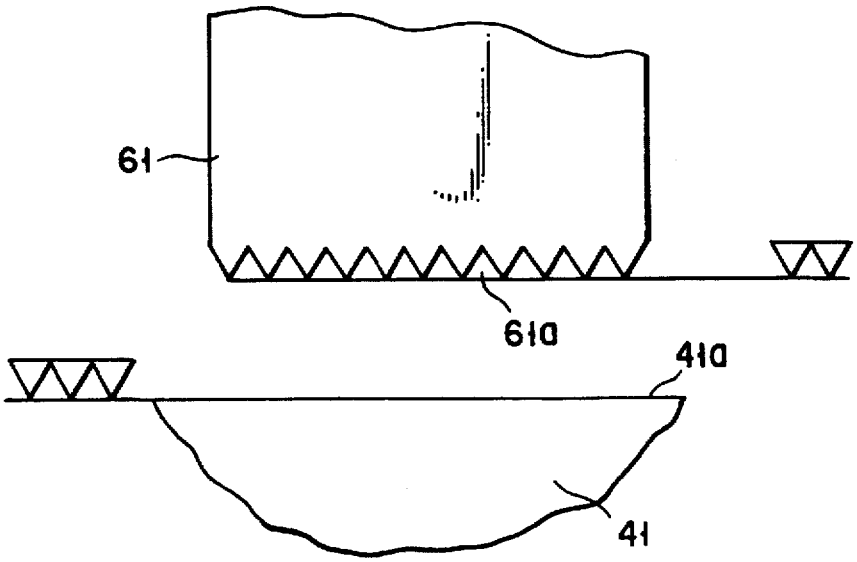

In FIG. 2A and 2B, there is shown an abutting portion P (solid propagation wave damping portion) where an end face 41*a* (first abutting surface) of the cylinder 41 and a lower surface 61*a* (second abutting surface) of the frame body 61 contact with each other. Specifically, the end face 41*a* of the cylinder is polished so that its surface has a high-precision finishing surface of ten-point mean surface roughness Rz=6.3 μm or less; and, the lower surface of the frame body 61 is subjected to cutting so that its surface has a low-precision finishing surface of ten-point mean surface roughness Rz=12.5 μm or more. Thus, the end face 41*a* of the cylinder 41 and a lower surface 61*a* of the frame body 61 linearly contact with each other, and a cross section of the abutting portion P becomes extremely small. The frame body 61 is formed into a shape such that its cross section is enlarged toward the sealing container 20 side from the abutting portion P.

Moreover, the aforesaid cylinder 41 and frame body 61 are both formed of a cast material. Vanadium is added to the cylinder 41 as an additive so that the metal composition density of the cylinder becomes high.

The foregoing hermetic compressor 10 compresses the compressed gas G as follows. Specifically, when driving the electric motor 30, the rotary shaft 33 is rotated with the roller 45 being eccentrically rotated in the compression chamber 44. Simultaneously, the compressed gas G supplied from accumulator 70 is introduced into the compression chamber 44 through the suction pipe 71 and the suction port 41*c*. The compression chamber 44 is partitioned by the roller 45 and the blade, and the volume of the partitioned compression chamber is gradually reduced as the rotary shaft 33 rotates. Therefore, the compressed gas G in the chamber is compressed, so that it becomes high pressure. Substantially, the compressed gas G pressurized to a predetermined pressure is discharged into the sealing container 20 through the muffler 50 from the discharge port.

Vibration is caused by pulsations accompanying the compressive operation of the compression mechanism 40. A propagation wave by the vibration is transmitted to the cylinder 41 as indicated by an arrow V in FIG. 2A, and then, reaches the abutting portion P. In the abutting portion P, the lower surface 61*a* of the frame body 61 linearly contacts the cylinder, so that a cross section of the abutting portion suddenly becomes small. Moreover, the frame body 61 and the cylinder 41 differ from each other in the metal composition density because the additive is added to the cylinder. Thus, a part of the solid propagation wave V reflects by the abutting portion P as indicated by an arrow Va in FIG. 2A, so that it is not transmitted to the sealing container 20. At this time, a main component of a solid propagation wave Va is a high frequency.

Also, an arrow Vb shown in FIG. 2A is indicative of a solid propagation wave which passes through the abutting portion P without being reflected by the abutting portion P, and is then transmitted to the frame body 61 side. This solid propagation wave Vb vibrates the sealing container 20.

Figure 3:
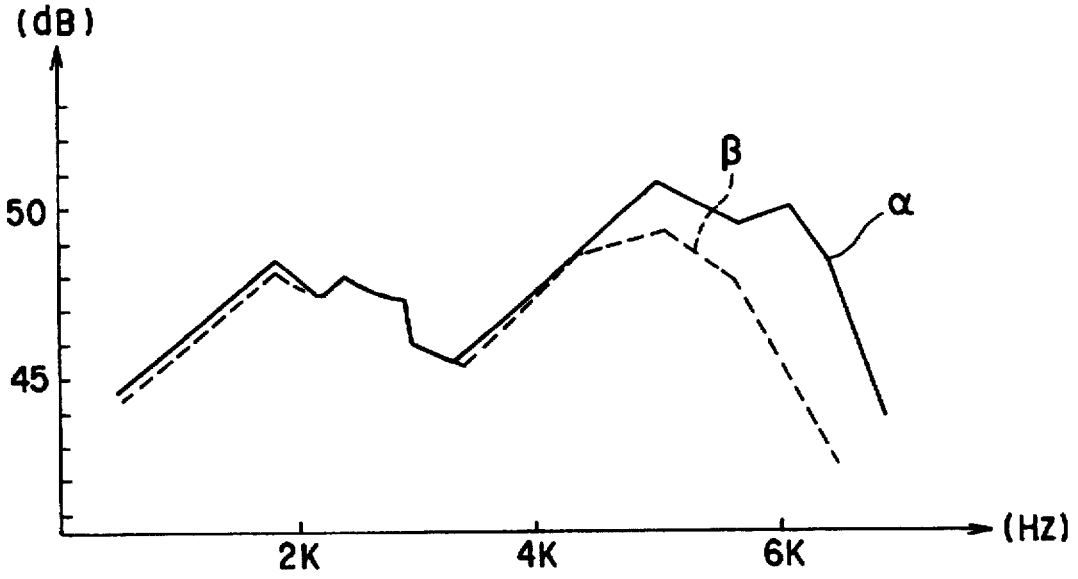
FIG. 3 is a graph showing a comparison between noise caused in the hermetic compressor of the present invention and noise caused in a conventional hermetic compressor.

As described above, in the hermetic compressor 10, the part Va of the solid propagation wave V caused in the compression mechanism 40 reflects by the abutting portion P, so that the only part Vb of the solid propagation wave is transmitted to the sealing container 20. To further clarify the difference in noise, measurements were made with respect to frequency characteristics of noise caused in the sealing container 20, results are shown in FIG. 3. In FIG. 3, a solid line α denotes noise of a conventional hermetic compressor; and a broken line β denotes noise of the hermetic compressor 10. More specifically, the solid propagation wave Va reflected by the abutting portion P contains a high-frequency component, so that the high-frequency component contained in noise caused when the hermetic compressor 10 is actuated, is less than that of the conventional hermetic compressor. Therefore, this serves to reduce harsh noise, whereby a hermetic compressor having an improved noiseless structure can be provided.

The lower surface 61*a* of the frame body 61 and the end face 41*a* of the cylinder 41 linearly contact each other, as described above. Thus, the lower surface 61*a* of the frame body 61 and the end face 41*a* of the cylinder 41 tightly face each other. This serves not only to prevent positional deviation due to vibration but also to improve impact resistance force. Moreover, the end face 41*a* of the cylinder 41 is subjected to high-precision finishing. This serves to securely position the compression mechanism 40 in the sealing container 20 with high accuracy.

As is evident from the above explanation, the hermetic compressor 10 of the first embodiment can prevent vibration caused in the compression mechanism from being transmitted to the sealing container without using any specific mechanisms, whereby a hermetic compressor having an improved noiseless structure can be provided.

Figure 4:
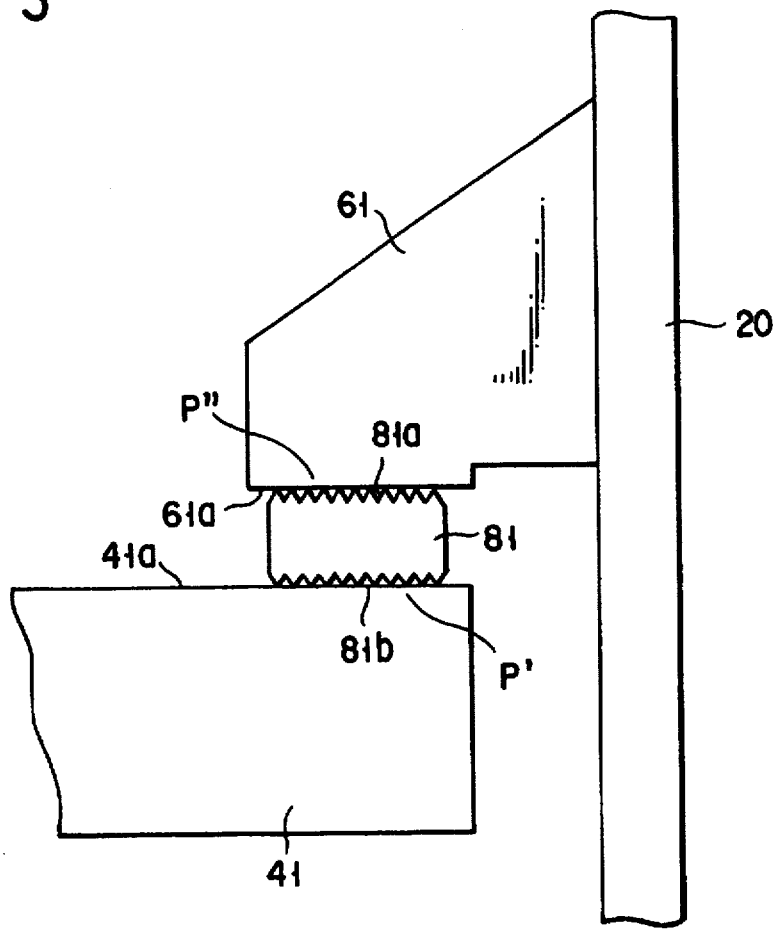
FIG. 4 is an illustrative view showing principle parts of a hermetic compressor according to a second embodiment of the present invention.

FIG. 4 is a view illustrating principle parts of a hermetic compressor 10A according to a second embodiment of the present invention. The construction of the hermetic compressor 10A of this second embodiment is substantially the same as that of the hermetic compressor of the first embodiment; therefore, the details will be omitted.

The hermetic compressor 10A of the second embodiment differs from the aforesaid hermetic compressor 10 in that a circular ring-like member 81 is interposed between the end face 41*a* of the cylinder and the lower surface 61*a* of the frame body 61.

More specifically, the member 81 is arranged so that its upper and lower surfaces 81*a* and 81*b* abut against the lower surface 61*a* of the frame body 61 and the end face 41*a* of the cylinder 41, respectively. Further, an abutting portion P' (solid propagation wave damping portion) between the lower surface 81*b* of the member 81 and the end face 41*a* of the cylinder 41, and an abutting portion P" (solid propagation wave damping portion) between the upper surface 81*a* of the member 81 and the lower surface 61*a* of the frame body 61 are shown. Also, the frame body 61, the cylinder 41 and the member 81 are formed of a cast material. Additives such as vanadium, etc. are added to the member 81 in order to increase the metal composition density of the member 81.

The end face 41*a* of the cylinder and the lower surface 61*a* of the frame body 61 are polished so that its surface has a high-precision finishing surface of ten-point mean surface roughness Rz=6.3 μm or less. On the other hand, the upper and lower surfaces 81*a* and 81*b* of the member 81 are subjected to cutting so that its surface has a low-precision finishing surface of ten-point mean surface roughness Rz=12.5 μm or more. Thus, there is provided a linear contact in the abutting portions P' and P".

The hermetic compressor 10A constructed as described above is actuated in the same manner as the aforesaid hermetic compressor 10. At this time, a solid propagation wave caused in the compression mechanism 40 passes through the cylinder 41, and then reaches the abutting portion P'. The abutting portion P' reflects a part of the solid propagation wave by the difference in quality between the cylinder 41 and the member 81 and sudden change of a cross section by linear contact, like the case of the abutting portion P of the aforesaid hermetic compressor 10.

Further, the part of the solid propagation wave passing through the abutting portion P' without being reflected reaches the abutting portion P". The abutting portion P" reflects a part of the solid propagation wave by the difference in quality between the frame body 61 and the member 81 and sudden change of a cross section by linear contact. As a result, only solid propagation wave, which passes through the abutting portions P' and P", vibrates the sealing container 20.

As described above, in the hermetic compressor 10A, a part of the solid propagation wave caused in the compression mechanism 40 is reflected by the abutting portion P'. Thus, only solid propagation wave passing through the abutting portion P' reaches the abutting portion P", and then, the part of solid propagation wave passing through the abutting portion P' is further reflected by the abutting P". In other words, the solid propagation wave caused in the compression mechanism 40 is damped by the abutting portions P' and P", and thereafter, vibrates the sealing container 20. Thus, this serves to prevent the sealing container from vibrating. At this time, the solid propagation wave reflected by the abutting portion P' and P" mainly contains a high frequency component, like the case of the aforesaid hermetic compressor 10; therefore, the high frequency component of noise caused when the hermetic compressor 10A is actuated is less than that of the conventional hermetic compressor. Thus, harsh noise can be reduced, and a hermetic compressor having an improved noiseless structure can be provided.

The lower surface 61*a* of the frame body 61 and the upper surface 81*a* of the member 81, and the end face 41*a* of the cylinder 41 and the lower surface 81*b* of the member 81, linearly contact with each other, respectively, as described above. Thus, the upper surface 81*a* of the member 81 and the lower surface 61*a* of the frame body 61 tightly face each other while the lower surface 81*b* of the member 81 and the end face 41*a* of the cylinder 41 tightly facing each other. This serves not only to prevent positional deviation due to vibration but also to improve impact resistance force. Moreover, the end face 41*a* of the cylinder 41 and the lower surface 61*a* of the frame body 61 are subjected to high-precision finishing. This serves to securely position the compression mechanism 40 in the sealing container 20 with high accuracy.

As is evident from the above explanation, the hermetic compressor 10A of the second embodiment can prevent vibration caused in the compression mechanism 40 from being transmitted to the sealing container 20 without using any specific mechanisms, whereby a hermetic compressor having an improved noiseless structure can be provided.

The present invention is not restricted to individual embodiments described above. Specifically, the above embodiments are applied to a one-cylinder vertical shaft type rotary; however, these embodiments may be applied to a two-cylinder vertical shaft type rotary. Besides the above description, of course, various modifications can be carried out without diverging from the scope of claims of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A hermetic compressor having vibration damping support which compresses a compressed gas, comprising:

a sealing container;

a compression mechanism constituting a cylinder and made of a cast material which is housed in said sealing container and compresses said compressed gas introduced into the inside thereof; and a frame made of a cast material for fixedly supporting said compression mechanism, said compression mechanism being fixedly supported so that an outer peripheral end face of said cylinder constituting said compression mechanism abuts against said frame, a solid propagation wave damping portion being provided in an abutting portion where said compression mechanism and said frame abut against each other, the outer peripheral end face of said compression mechanism constituting a first abutting surface of said solid propagation wave damping portion and a portion of said frame abutted by said outer peripheral end face of said compression mechanism constituting a second abutting surface of said solid propagation wave damping portion, said first abutting surface and said second abutting surface being formed to have different finishing surface precision, said solid propagation wave damping portion damping vibration by suddenly changing a cross section of said abutting portion, wherein said abutting portion functions as a path for transmitting vibration caused in said compression mechanism to said sealing container.

2. The hermetic compressor according to claim 1, in which said solid propagation wave damping portion is constructed so that the first abutting surface of said compression mechanism abutting against said frame is formed with a high-precision finishing surface and so that the second abutting surface of said frame abutting against said compression mechanism is formed with a low-precision finishing surface.

3. The hermetic compressor according to claim 1, in which said solid propagation wave damping portion is constructed so that said first abutting surface of said compression mechanism abutting against said frame is formed with a low-precision finishing surface and so that said second abutting surface of said frame abutting against said compression mechanism is formed with a high-precision finishing surface.

4. The hermetic compressor according to claim 1, in which said solid propagation wave damping portion is constructed so that a cross section of said frame is enlarged toward a sealing container side from said abutting portion.

5. The hermetic compressor according to claim 1, in which said cylinder and frame are formed of a cast material, and an additive is added to either said cylinder or frame to increase the density of the metal composition of either said cylinder or frame.

6. A hermetic compressor, having vibration damping support, comprising:

a sealing container;

a compression mechanism constituting a cylinder and made of a cast material which is housed in said sealing container and compresses gas introduced into an inner space of said compression mechanism;

a frame made of a cast material for supporting said compression mechanism; and a solid propagation wave damping portion comprising a member interposed between said frame and said compression mechanism such that a first surface of said member is in abutting contact with an abutting surface of said frame and a second surface of said member opposite said first surface is in abutting contact with an outer peripheral portion of the cylinder constituting said compression mechanism, wherein a one of said first surface of said member and said abutting surface of said frame is finished to a higher precision surface than the other and a one of said second surface of said member and said outer peripheral portion of said compression mechanism is finished to a higher precision surface than the other.

7. The hermetic compressor according to claim 1, in which said member is formed into a circular ring-like shape.

* * * * *